US009235178B2

(12) United States Patent
Hashimoto

(10) Patent No.: US 9,235,178 B2
(45) Date of Patent: Jan. 12, 2016

(54) IMAGE PROCESSING APPARATUS

(75) Inventor: Minoru Hashimoto, Chigasaki (JP)

(73) Assignee: CANON KABUSHIKI KAISHA (JP)

( * ) Notice: Subject to any disclaimer, the term of this patent is extended or adjusted under 35 U.S.C. 154(b) by 931 days.

(21) Appl. No.: 12/721,823

(22) Filed: Mar. 11, 2010

(65) Prior Publication Data

US 2010/0231390 A1 Sep. 16, 2010

(30) Foreign Application Priority Data

Mar. 13, 2009 (JP) ..... 2009-061435

(51) Int. Cl.
*G08B 23/00* (2006.01)
*G03G 15/00* (2006.01)

(52) U.S. Cl.
CPC ..... *G03G 15/5004* (2013.01)

(58) Field of Classification Search
USPC ..... 340/573.1, 541, 552, 523; 399/16, 53, 399/389, 405
See application file for complete search history.

(56) References Cited

U.S. PATENT DOCUMENTS 4,437,089 A * 3/1984 Achard ..... G08B 13/2491 250/DIG. 1
4,733,081 A * 3/1988 Mizukami ..... G07C 9/00 250/221
5,225,806 A * 7/1993 Stanley-Arslanok .. G08B 25/14 340/506
5,689,235 A * 11/1997 Sugimoto ..... G08B 13/22 340/531
5,777,755 A * 7/1998 Aoki ..... H04N 1/047 358/404
5,798,703 A * 8/1998 Sakai ..... F16P 3/12 307/119
5,819,013 A * 10/1998 Miyazaki ..... H04N 1/00278 347/3
5,933,581 A * 8/1999 Miyazaki ..... H04N 1/00278 358/1.14
6,252,506 B1 * 6/2001 Hsieh ..... G08B 13/1645 250/338.3
6,320,510 B2 * 11/2001 Menkedick ..... 340/5.1
6,331,818 B1 * 12/2001 Hiraga ..... A61B 5/0013 340/573.1
6,456,403 B1 * 9/2002 Archer ..... H04N 1/00795 358/468
6,620,108 B2 * 9/2003 Duval ..... A61B 5/18 340/573.1
6,658,218 B2 * 12/2003 Krolczyk ..... B65H 43/00 399/16
6,812,835 B2 * 11/2004 Ito ..... G08B 13/19604 340/541
6,911,907 B2 * 6/2005 Kelliher ..... G07C 9/00166 340/5.1
6,943,685 B2 * 9/2005 Seo ..... G08B 13/191 340/541
6,948,081 B2 * 9/2005 Lee ..... G06F 1/3218 713/310
7,023,568 B2 * 4/2006 Tsunekawa ..... H04N 1/00633 271/298
7,057,519 B2 * 6/2006 Study ..... G05B 19/0428 318/280

(Continued)

FOREIGN PATENT DOCUMENTS

EP 444227 A * 9/1991
JP 01267711 A * 10/1989 ..... G06F 1/00

(Continued)

*Primary Examiner* — Paul Obiniyi
(74) *Attorney, Agent, or Firm* — Rossi, Kimms & McDowell LLP

(57) ABSTRACT

An image processing apparatus that enables to prolong lives of device parts of which lives are limited by preventing unnecessary returns from the power saving mode, and reduce unnecessary power consumption. A first living body detection unit detects a living body that approaches the apparatus to input a trigger. A second living body detection unit detects a living body that approaches the apparatus for other purposes. A switching unit switches a mode from a first electric power mode to a second electric power mode when the first living body detection unit detects the living body and when the second living body detection unit does not detect the living body, and maintains the first electric power mode when the first living body detection unit detects the living body and when the second living body detection unit detects the living body.

12 Claims, 13 Drawing Sheets

(56) References Cited

U.S. PATENT DOCUMENTS 7,248,174 B2 * 7/2007 Study ..... G05B 19/0428 318/280
7,260,751 B2 * 8/2007 Fujinawa ..... G06F 3/121 710/15
7,286,871 B2 * 10/2007 Cohen ..... A61B 5/04017 600/300
7,307,359 B2 * 12/2007 Takaku ..... B60K 37/00 307/10.1
7,367,133 B2 * 5/2008 Hagl ..... G01B 21/045 33/503
7,427,914 B2 * 9/2008 Plantamura ..... B60W 50/14 340/425.5
7,428,391 B2 * 9/2008 Kobayashi ..... G03G 15/5004 399/88
7,466,224 B2 * 12/2008 Ward ..... G07C 9/00111 340/5.2
7,555,754 B2 * 6/2009 Fujinawa ..... B41J 29/38 714/44
7,660,018 B2 * 2/2010 Shimizu ..... G06T 7/0002 358/3.26
7,973,777 B2 * 7/2011 Lee ..... G06F 3/0414 345/175
7,978,084 B2 * 7/2011 Dixon ..... A61G 7/05 340/286.07
8,015,421 B2 * 9/2011 Chang ..... G06F 1/3203 713/300
8,024,499 B1 * 9/2011 Aybay ..... H04L 12/403 710/46
8,089,645 B2 * 1/2012 Soda ..... G06K 15/005 358/1.14
8,135,118 B2 * 3/2012 Nakagawa ..... H04M 1/82 379/142.04
2001/0003356 A1 * 6/2001 Yon ..... G01J 5/10 250/338.1
2002/0015171 A1 * 2/2002 Tsunekawa ..... H04N 1/00633 358/1.13
2003/0014675 A1 * 1/2003 Lee ..... G06F 1/3218 713/310
2003/0117711 A1 * 6/2003 Kowarz ..... H04N 5/7416 359/618
2003/0123886 A1 * 7/2003 Krolczyk ..... B65H 43/00 399/16
2004/0061283 A1 * 4/2004 Hyun ..... B65H 7/02 271/265.01
2004/0097802 A1 * 5/2004 Cohen ..... A61B 5/04017 600/411
2004/0113771 A1 * 6/2004 Ozaki ..... A61B 5/0002 340/539.12
2004/0222891 A1 * 11/2004 Ehlers ..... G08B 21/0211 340/573.1
2005/0068165 A1 * 3/2005 Kelliher ..... G07C 9/00166 340/523
2005/0093368 A1 * 5/2005 Takaku ..... B60K 37/00 307/10.1
2005/0144623 A1 * 6/2005 Fujinawa ..... B41J 29/38 719/318
2005/0198223 A1 * 9/2005 Fujinawa ..... G06F 3/121 709/220
2005/0204144 A1 * 9/2005 Mizutani ..... G06F 3/1222 713/182
2005/0242484 A1 * 11/2005 Ono ..... B65H 39/042 271/6
2005/0286437 A1 * 12/2005 Matsushita ..... H04L 63/061 370/252
2006/0006316 A1 * 1/2006 Takenaka ..... G05D 1/0272 250/221
2006/0007467 A1 * 1/2006 Tsunekawa ..... H04N 1/00633 358/1.13
2007/0001835 A1 * 1/2007 Ward ..... G07C 9/00111 340/522
2007/0014586 A1 * 1/2007 Kobayashi ..... G03G 15/5004 399/70
2007/0109605 A1 * 5/2007 Shimizu ..... G06T 7/0002 358/3.26
2007/0242860 A1 * 10/2007 Hasebe ..... G06K 9/00255 382/118
2007/0280706 A1 * 12/2007 Yasukawa ..... G03G 15/5079 399/8
2007/0286656 A1 * 12/2007 Ito ..... G03G 15/70 399/389
2008/0054550 A1 * 3/2008 Hama ..... B65H 31/26 271/220
2008/0130858 A1 * 6/2008 Nakagawa ..... H04M 1/82 379/207.03
2008/0163363 A1 * 7/2008 Mizutani ..... G06F 3/1222 726/19
2008/0165002 A1 * 7/2008 Tsuji ..... G01S 7/40 340/552
2008/0297837 A1 * 12/2008 Soda ..... G06K 15/005 358/1.15
2009/0063882 A1 * 3/2009 Chang ..... G06F 1/3203 713/320
2009/0129802 A1 * 5/2009 Yasukawa ..... G03G 15/5012 399/53
2009/0257103 A1 * 10/2009 Pellar ..... H04N 1/46 358/514
2009/0261524 A1 * 10/2009 Nakayama ..... B65H 3/44 271/3.14
2009/0303375 A1 * 12/2009 Ohyama ..... H04N 5/23219 348/333.12
2010/0033424 A1 * 2/2010 Kabasawa ..... G01C 17/28 345/156
2010/0079827 A1 * 4/2010 Matsushima ..... H04N 1/00567 358/498
2010/0320845 A1 * 12/2010 Chang ..... G06F 1/3203 307/116
2011/0123242 A1 * 5/2011 Shishikura ..... G03G 15/6573 399/405

FOREIGN PATENT DOCUMENTS

JP 07225508 A * 8/1995 ..... G03G 15/043
JP 11-202690 A 7/1999
JP 11202690 A * 7/1999 ..... G03G 21/00
JP 11284783 A * 10/1999
JP 2000333371 A * 11/2000 ..... H02J 3/38
JP 2007230001 A * 9/2007

* cited by examiner

IMAGE PROCESSING APPARATUS

BACKGROUND OF THE INVENTION

1. Field of the Invention

The present invention relates to an image processing apparatus (an image forming apparatus), and particularly relates to the image processing apparatus that is characterized in a human body (living body) detection technique for switching an electric power mode.

2. Description of the Related Art

A conventional image processing apparatus supports a power saving mode in which electric power supplied to almost all units inside the apparatus is cut in order to achieve power saving. Since a return to a normal mode from the power saving mode needs to turn on a power, time is taken, which may impair a user's convenience.

In order to solve the problem, some conventional image processing apparatuses that support the power saving mode are provided with a human body detection unit and return to the normal mode from the power saving mode when detecting a human body (for example, see Japanese laid-open patent publication (Kokai) No. H11-202690 (JP H11-202690A)). This has an effect to shorten an apparent starting time for a user.

In the technique disclosed in the above-mentioned publication, since the image processing apparatus returns to the normal mode whenever the user approaches the image processing apparatus, the apparatus uselessly returns to the normal mode even when it is unnecessary.

For example, it is necessary to return to the normal mode when the user operates an operation unit. However, it is unnecessary to return the image processing apparatus from the power saving mode when coming to pick up ejected paper to a paper ejection unit, when supplementing paper to a paper feeding unit, and when supplying toner. Unnecessary start-up of the image processing apparatus uselessly consumes lives of devices of which the numbers of times of start-up are limited.

For example, the devices of which lives are limited include a HDD, a relay that turns on/off electric power in an electric power source unit, a fuse used in the electric power source unit, etc. Moreover, unnecessary electric power is consumed until the once-started image processing apparatus shifts to the power saving mode again.

SUMMARY OF THE INVENTION

The present invention provides a image processing apparatus that can prolong lives of device parts of which lives are limited by preventing unnecessary returns from a power saving mode, and can reduce unnecessary power consumption.

Accordingly, a first aspect of the present invention provides an image processing apparatus that has a plurality of electric power modes including a first electric power mode and a second electric power mode that are different in conditions for supplying electric power inside the apparatus, the image processing apparatus comprising a switching unit adapted to operate in the first electric power mode and to switch the electric power mode when detecting a trigger, a first living body detection unit adapted to be arranged so as to detect a living body that approaches the apparatus to input the trigger, and a second living body detection unit adapted to be arranged so as to detect a living body that approaches the apparatus for a purpose other than the input of the trigger, wherein the switching unit switches the mode to the second electric power mode from the first electric power mode when the first living body detection unit detects the living body and when the second living body detection unit does not detect the living body, and wherein the switching unit maintains the first electric power mode when the first living body detection unit detects the living body and when the second living body detection unit detects the living body.

Accordingly, a second aspect of the present invention provides an image processing apparatus that has a plurality of electric power modes including a first electric power mode and a second electric power mode that are different in conditions for supplying electric power inside the apparatus, the image processing apparatus comprising a switching unit adapted to operate in the first electric power mode and to switch the electric power mode when detecting a trigger, a first living body detection unit adapted to be arranged so as to detect a living body that approaches the apparatus to input the trigger, and a second living body detection unit adapted to be arranged so as to detect a living body that approaches the apparatus for a purpose other than the input of the trigger, wherein the first living body detection unit defines first detection intensity that is detected when the living body approaches the apparatus at a predetermined distance, and second detection intensity that is detected when the living body approaches the apparatus at a distance shorter than the predetermined distance, wherein the switching unit switches the mode to the second electric power mode from the first electric power mode when the first living body detection unit detects the living body at the second detection intensity, wherein the switching unit switches the mode to the second electric power mode from the first electric power mode when the first living body detection unit detects the living body at the first detection intensity and when the second living body detection unit does not detect the living body, and wherein the switching unit maintains the first electric power mode when the first living body detection unit detects the living body at the first detection intensity and when the second living body detection unit detects the living body.

Accordingly, a third aspect of the present invention provides an image processing apparatus that has a plurality of electric power modes including a first electric power mode and a second electric power mode that are different in conditions for supplying electric power inside the apparatus, the image processing apparatus comprising a switching unit adapted to operate in the first electric power mode and to switch the electric power mode when detecting a trigger, a condition detection unit adapted to detect a specific condition of the apparatus, and a first living body detection unit adapted to be arranged so as to detect a living body that approaches the apparatus to input the trigger, wherein the first living body detection unit defines first detection intensity that is detected when the living body approaches the apparatus at a predetermined distance, and second detection intensity that is detected when the living body approaches the apparatus at a distance shorter than the predetermined distance, wherein the switching unit switches the mode to the second electric power mode from the first electric power mode when the first living body detection unit detects the living body at the second detection intensity, wherein the switching unit switches the mode to the second electric power mode from the first electric power mode when the first living body detection unit detects the living body at the first detection intensity and when the condition detection unit does not detect the specific condition, and wherein the switching unit maintains the first electric power mode when the first living body detection unit detects the living body at the first detection intensity and when the condition detection unit detects the specific condition.

According to the present invention, lives of the device parts of which lives are limited can be prolonged by preventing unnecessary returns from the power saving mode, and unnecessary power consumption can be reduced.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
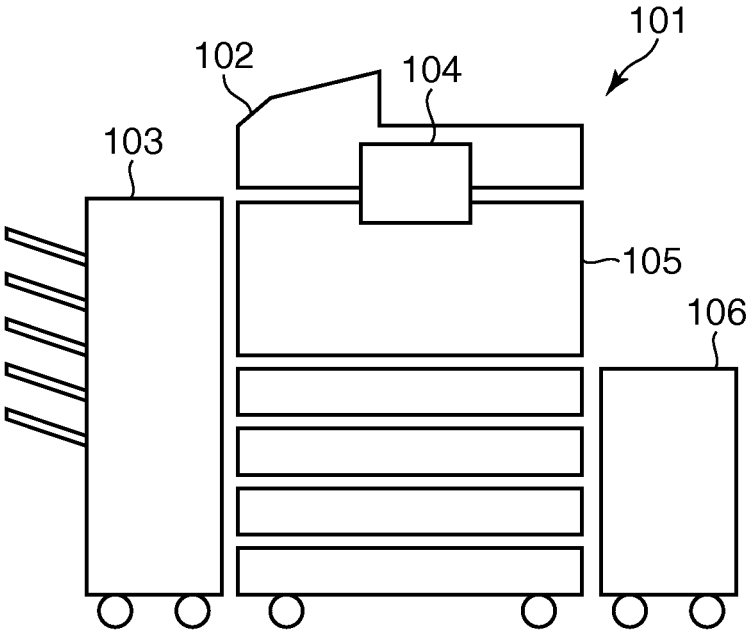
FIG. 1 is an external view showing an MFP as an image processing apparatus according to a first embodiment of the present invention.

FIG. 1 is an external view showing an MFP 101 as an image processing apparatus according to a first embodiment of the present invention.

The MFP (multifunction peripheral device) 101 has functions such as a copy, a scanner, a facsimile, and a printer, and has a plurality of electric power modes including a first electric power mode (a power saving mode) and a second electric power mode (a normal mode), which are different in a condition of an electric power supply inside the device.

A reader unit 102 is a position on which a user puts a paper original, reads the paper original by a sensor, and outputs electronic data. An operation unit 104 consists of buttons that are used by a user to give instructions to the device and a display device that displays a condition of the device and an operation menu.

A printer unit 105 prints a desired image on paper by forming a toner image on the paper fed from a paper feeding unit 106 and fixing the toner image. The printed paper is ejected by a paper ejection unit 103. The paper feeding unit 106 holds the paper. The user can add paper to the paper feeding unit 106.

Figure 2:
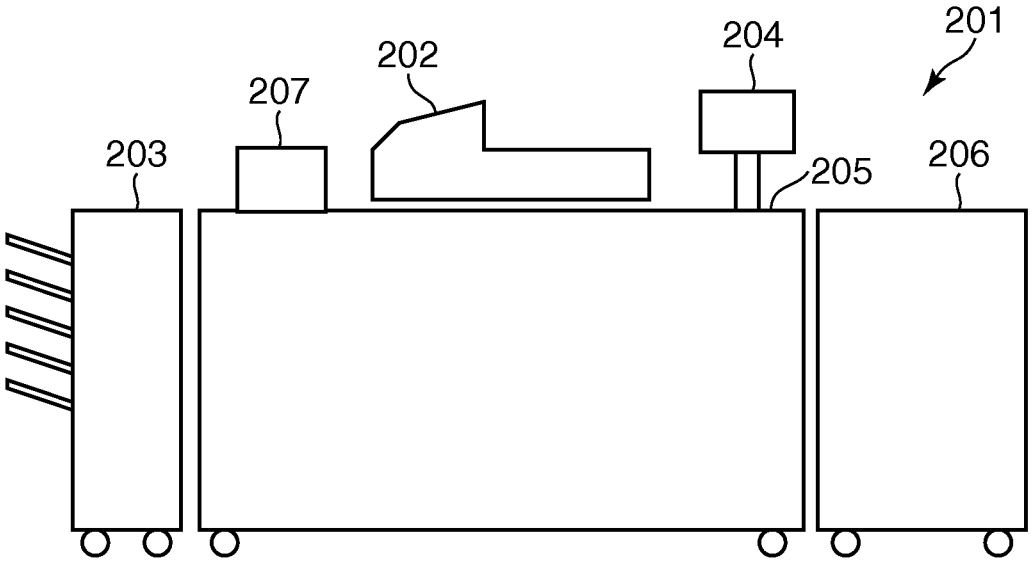
FIG. 2 is an external view showing a large-size MFP as an image processing apparatus according to a second embodiment of the present invention.

FIG. 2 is an external view showing a large-size MFP 201 as an image processing apparatus according to a second embodiment of the present invention.

Since the large-size MFP 201 is ready for a high speed printing and a continuous large number printing, an external shape of the MFP 201 is larger than the normal MFP 101. Particularly, a printer unit 205, a paper feeding unit 206, a paper ejection unit 203, and an operation unit 204 are large-sized. A reader unit 202 also achieves a higher operation speed. A toner supplying unit 207 is arranged at a position that is easy to supply toner in order to achieve a high-speed continuous operation of the large-size MFP 201.

The user mainly approaches the MFP 101 and the large-size MFP 201 when operating the operation unit, when picking up ejected paper, when adding paper, and when supplying the toner. When using the large-size MFP 201, standing points of the user are different largely according to operations performed by the user, as compared with the MFP 101.

Figure 3:
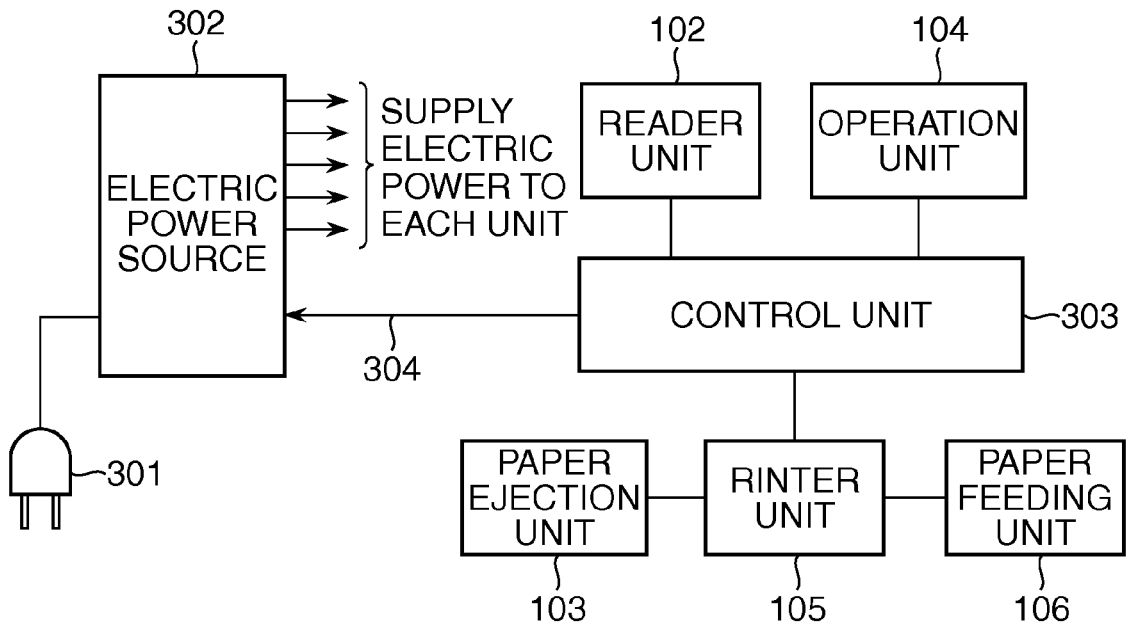
FIG. 3 is a block diagram schematically showing a hardware configuration inside the MFP shown in FIG. 1.

FIG. 3 is a block diagram schematically showing a hardware configuration inside the MFP 101 shown in FIG. 1.

Although FIG. 3 shows the hardware configuration inside the MFP 101 of FIG. 1, it is assumed that the large-size MFP 201 of FIG. 2 also has the inside configuration as shown in FIG. 3.

A plug 301 is inserted into a plug socket of commercial alternating current electric power source and supplies AC electric power to an electric power source unit 302. The electric power source unit 302 supplies electric power to each unit in the device. That is, the electric power source unit 302 converts the alternating current electric power into a voltage suitable for each unit, and converts the alternating current into a direct current if needed. A control unit 303 controls other units, processes electronic data and transmits the same.

An electric power source control signal 304 is for controlling On/Off of an output of the electric power source unit 302 by the control unit 303. The MFP 101 has the normal mode of an operation and the power saving mode that reduces electric power consumption significantly.

In the power saving mode, in order to reduce the electric power consumption, the electric power for the reader unit 102, the paper ejection unit 103, the printer unit 105, and the paper feeding unit 106 is disconnected. Interiors of the control unit 303 and the operation unit 104 operate partially, and the electric power for the other parts thereof is disconnected. The electric power is supplied to only a circuit that detects a trigger to return to the normal mode from the power saving mode.

The triggers are a reception of a facsimile, a reception of a job via a network, a depression of a button of the operation unit 104, etc. In the power saving mode, it is desirable that the user who depresses the button of the operation unit 104 can use the operation unit 104 as soon as possible.

However, the retuning may require several seconds through several tens of seconds depending on software and hardware that control the operation unit 104. For example, a relay that turns On/Off electric power, a HDD, etc. have lives (several tens of thousands of times in a few example). For example, a life of the relay is a life of a contact, and a life of the HDD is determined by accumulation of mechanical stresses to a storage medium and a head.

Therefore, the number of times for switching between the power saving mode and the normal mode has a limit. Accordingly, it is desirable that the number of times for switching is minimized.

Figure 4:
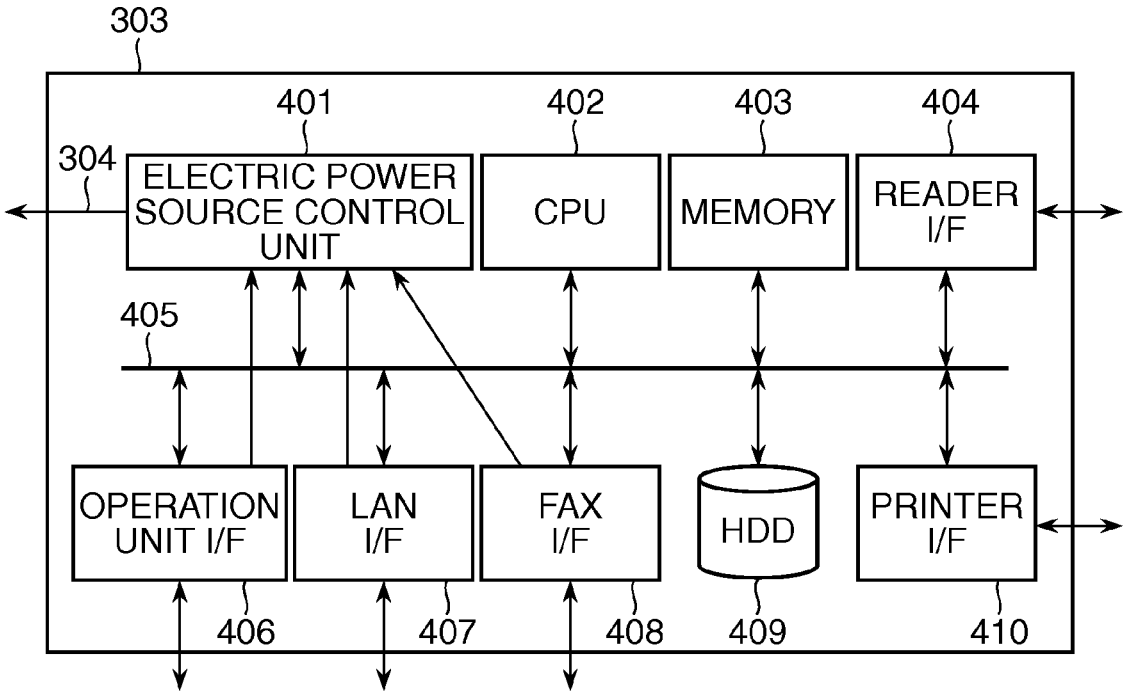
FIG. 4 is a block diagram schematically showing a configuration of a control unit in FIG. 3.

FIG. 4 is a block diagram schematically showing a configuration of the control unit 303 in FIG. 3.

In FIG. 4, a CPU 402 executes a process of the control unit 303 and uses a memory 403.

A reader I/F 404 is an interface for communicating with the reader unit 102. An internal bus 405 is used in order that the CPU 402 communicates with each block in the control unit 303. An operation unit I/F 406 is an interface for communicating with the operation unit 104, transmits display data, and receives information inputted by a user through buttons, a touch panel, etc.

A LAN I/F 407 is connected to a network such as the Ethernet (registered trademark), and transfers and receives job data, a command, and status. A FAX I/F 408 is an interface that is connected to a public telephone line and performs communications of FAX images.

An HDD 409 stores programs and an OS that are used by the CPU 402. The HDD 409 stores job data and image data as files. The job data is used by the MFP to execute functions and is PDL (Page Description Language) data for a printing process received via the LAN I/F 407 from a client PC (not shown), for example. A printer I/F 410 is an interface to communicate with the printer unit 105, and transfers and receives a command, status, and image data.

An electric power source control unit 401 is a block that controls a shift of the mode of the MFP between the normal rode and the power saving mode. The electric power source control unit 401 varies the electric power source control signal 304 to shift to the power saving mode from the normal mode according to a command from the CPU 402.

The electric power source control unit 401 functions as a switching unit that can operate in a first electric power mode (the power saving mode) and switches an electric power mode when detecting a trigger.

In the power saving mode, the electric power source control unit 401 monitors start-up signals from the operation unit I/F 406, the LAN I/F 407, and the FAX I/F 408, and varies the electric power source control signal 304 so as to return to the normal mode from the power saving mode when detecting a variation.

Figure 5:
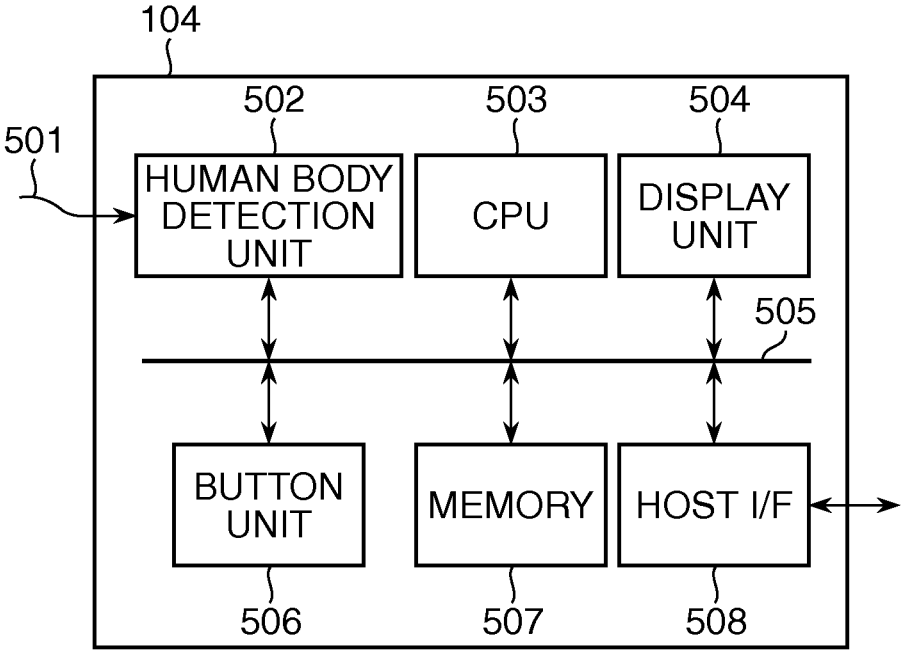
FIG. 5 is a block diagram schematically showing an configuration of an operation unit in FIG. 3.

FIG. 5 is a block diagram schematically showing an configuration of the operation unit 104 in FIG. 3.

In FIG. 5, a human body detection unit (a first living body detection unit) 502 and an antenna 501 are a block that performs human body detection by an electrostatic capacity method, determines an approach and leaving of the user, and transmits a result to the control unit 303 via a host I/F 508.

A CPU 503 controls the operation unit 104 and uses a memory 507 for an operation. The memory 507 consists of a nonvolatile program memory and a rewritable temporary memory.

A display unit 504 displays data received from the control unit 303 via the host I/F 508 onto an LCD. A button unit 506 consists of push buttons, a touch panel overlaid on the LCD, etc. When detecting variation of the buttons or the touch panel, the CPU 503 transmits the variation of the buttons or the touch panel to the control unit 303 via the host I/F 508.

Blocks in the operation unit 104 are connected via an internal bus 505. In the power saving mode, the electric power is supplied to a part of the human body detection unit 502 and a part of the host I/F 508 in order to reduce the electric power consumption.

It should be noted that although the embodiment shows the configuration in which the human body detection unit 502 is equipped in the operation unit 104, the human body detection unit 502 may be connected with the internal bus 405. Although the embodiment shows the configuration in which the CPU 503 and the memory 507 are equipped in the operation unit 104, the CPU 402 may control the operation unit 104 and the operation unit 104 may have no CPU and no memory.

As mentioned above, when the user returns the MFP from the power saving mode by a button operation, it is desirable to return as soon as possible. Since the human body detection unit is equipped in the MFP, the MFP returns to the normal mode when detecting an approach of the user, which can obtain an effect that shortens an apparent recovery time.

Figure 6:
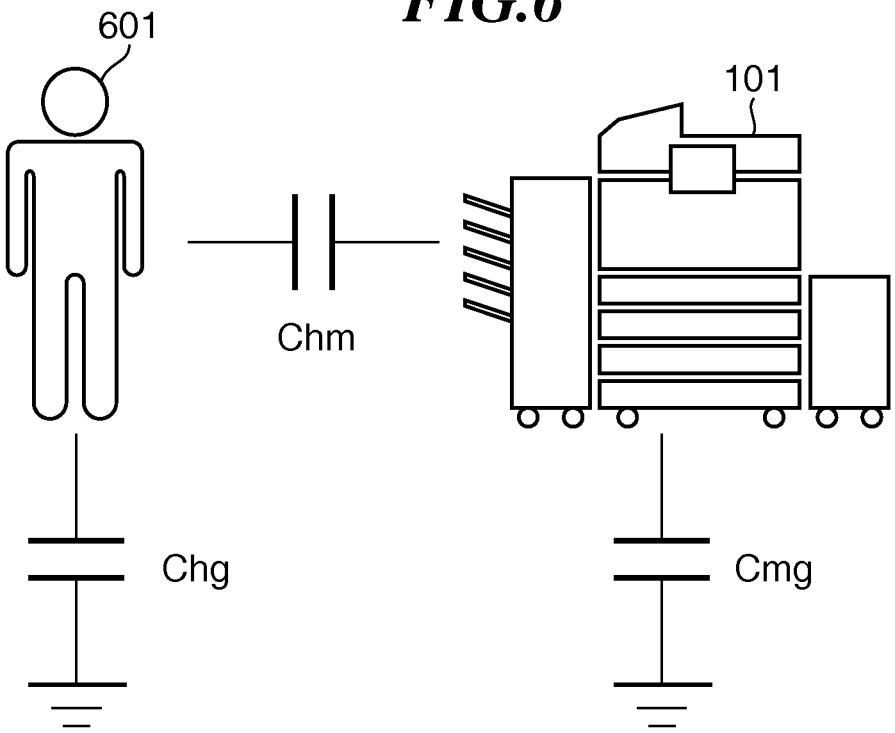
FIG. 6 is a view showing an operating principle of human body detection by a human body detection unit by an electrostatic capacity method in FIG. 5.

FIG. 6 is a view showing an operating principle of the human body detection by the human body detection unit 502 by the electrostatic capacity method in FIG. 5.

On an occasion of the human body detection by the electrostatic capacity method, an electrostatic capacity Chm between the antenna 501 equipped to the MFP 101 and a human body 601 is measured. The electrostatic capacity Chm varies with a distance between the antenna 501 and the human body 601. However, the electrostatic capacity that can be measured by the antenna 501 actually is a synthetic capacity C that is a sum of an electrostatic capacity Chg between the human body 601 and the ground, an electrostatic capacity Cmg between the MFP 101 and the ground, in addition to the electrostatic capacity Chm. The synthetic capacity C is defined by a formula 1.

$$C=(Chm+Chg)/Cmg \quad \text{(Formula 1)}$$

Since the electrostatic capacities Chg and Cmg vary with an environment, the MFP determines whether the human body 601 approaches the MFP 101 or not on the basis of a relative value with respect to a basic noise level. A feature of the human body detection by the electrostatic capacity method is a point that can grasp the distance between the human body 601 and the MFP 101 relatively as shown by the formula 1. Since power consumption is also low, it is suitable for an operation in the power saving mode.

Figure 7:
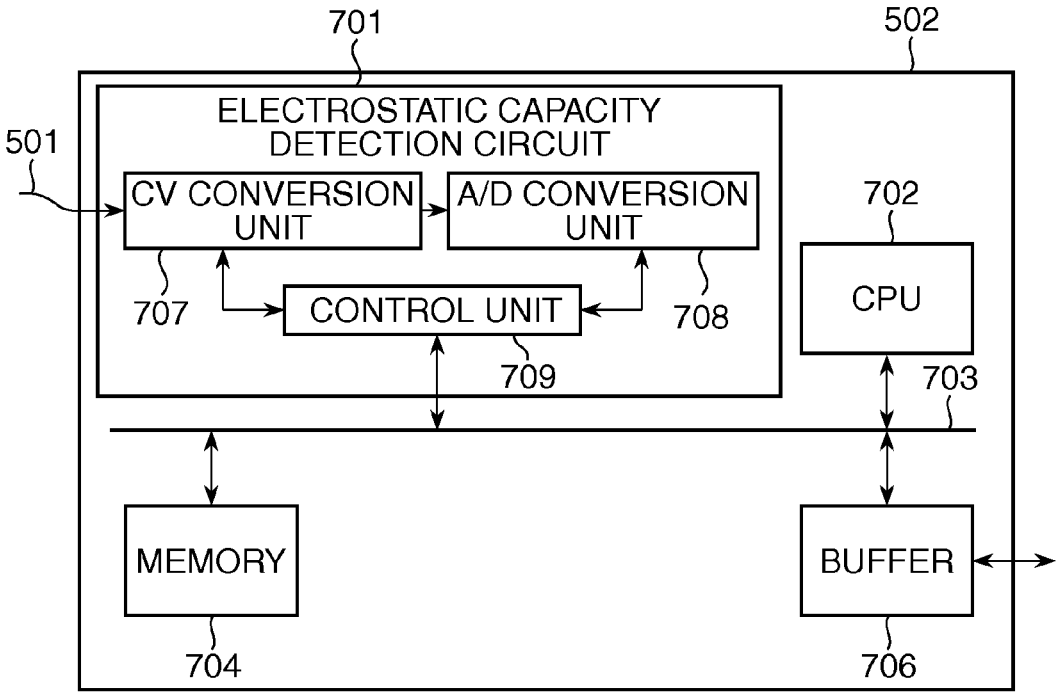
FIG. 7 is a block diagram schematically showing a configuration of the human body detection unit in FIG. 5.

FIG. 7 is a block diagram schematically showing a configuration of the human body detection unit 502 in FIG. 5.

In FIG. 7, an electrostatic capacity detection circuit 701 comprises a CV conversion unit 707, an A/D conversion unit 708, and a control unit 709. The CV conversion unit 707 to which the antenna 501 is connected converts electrostatic capacity between the antenna 501 and the ground into a voltage value. The voltage value outputted from the CV conversion unit 707 is converted into a digital value by the A/D conversion unit 708.

According to commands issued from a CPU 702, the control unit 709 controls the CV conversion unit 707 and the A/D conversion unit 708. The CPU 702 reads the acquired digital value and operates for a noise rejection, a level conversion, etc. A memory 704 consists of a nonvolatile program memory and a rewritable temporary memory.

Blocks in the human body detection unit 502 are connected via an internal bus 703. A buffer 706 connects the internal bus 703 of the human body detection unit 502 with the internal bus 505 of the operation unit 104.

Figure 8:
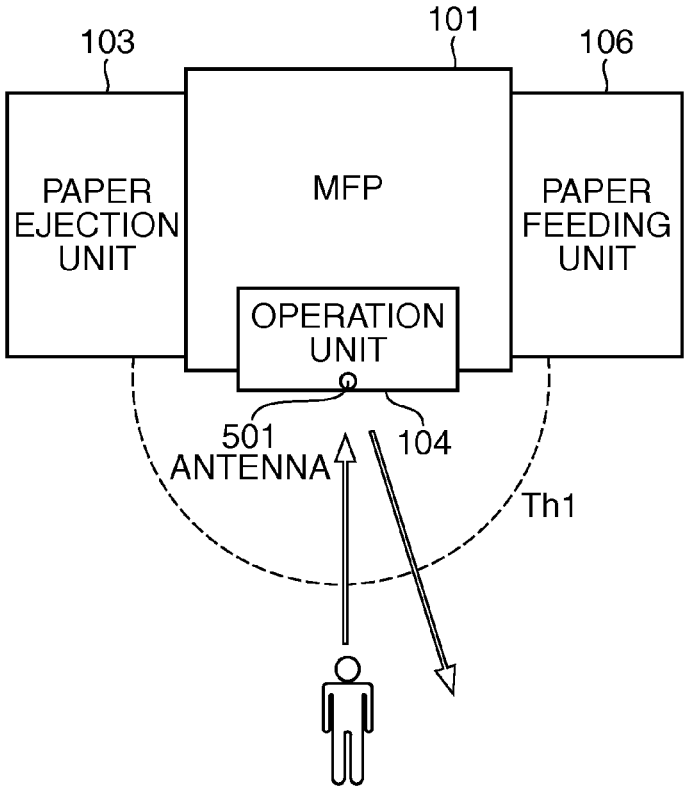
FIG. 8 is a top view of the MFP having an antenna on the operation unit in which a locus of a user who came to operate the operation unit is entered.

FIG. 8 is a top view showing the MFP 101 having the antenna 501 on the operation unit 104 in which a locus of the user who came to operate the operation unit 104 is entered.

In FIG. 8, a reference sign Th1 is a threshold value for detecting the human body by the human body detection unit 502. When the human body is in a circle shown by the threshold value Th1, it is determined that the human body is detected. Since there is no directivity in the human body detection by the electrostatic capacity method, the threshold value Th1 is shown as a circle.

The reason why the antenna 501 is arranged on the operation unit 104 is because a return button that the user pushes to shift from the power saving mode to the normal mode is arranged on the operation unit 104. The antenna 501 may be arranged on another position as long as the user who approaches to the operation unit 104 is detectable.

Figure 9:
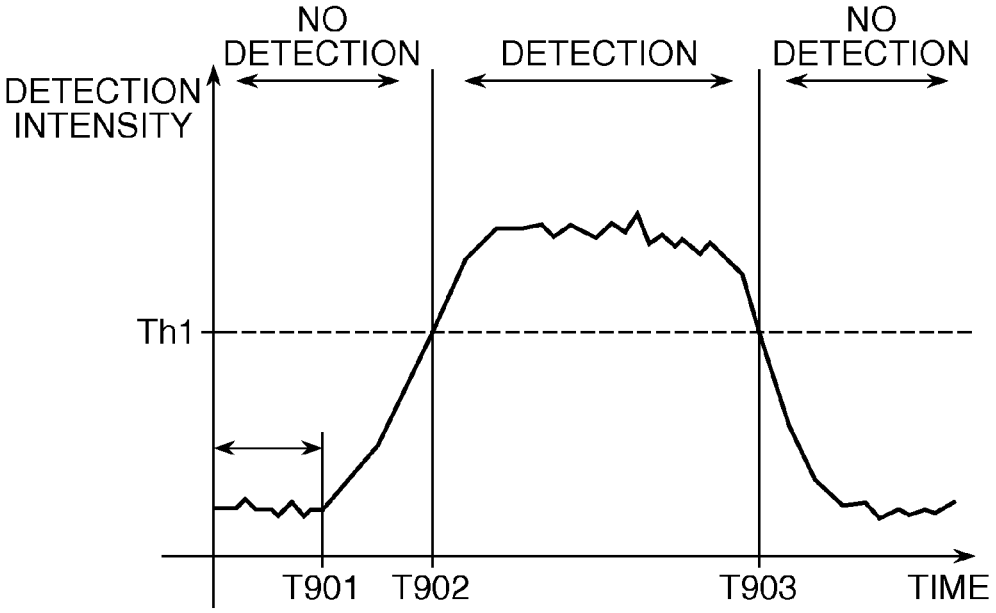
FIG. 9 is a graph showing a relation between detection intensity of an electrostatic capacity detection circuit in FIG. 7 and time with respect to the locus of the user in FIG. 8.

FIG. 9 is a graph showing a relation between detection intensity of the electrostatic capacity detection circuit 701 in FIG. 7 and time with respect to the locus of the user in FIG. 8.

In FIG. 9, since the user is apart from the MFP 101 in a period from an origin in the graph to T901, the detection intensity is in the noise level. The detection intensity gradually increases from T901, and it is determined that the human body is detected when the detection intensity exceeds the threshold value Th1. When the detection intensity becomes smaller than the threshold value Th1 at T903, it is determined that the user leaves from the MFP 101.

The above description is a general operation example of the MFP that is equipped with the human body detection unit 502 by the electrostatic capacity method. Accordingly, since the MFP can start before the user pushes the button to return from the power saving mode to the normal mode, which improves convenience to the user.

As mentioned above, the user may approach the MFP for a purpose other than operations of the operation unit 104. For example, the user may come to pick up ejected paper from the paper ejection unit 103.

Figure 10:
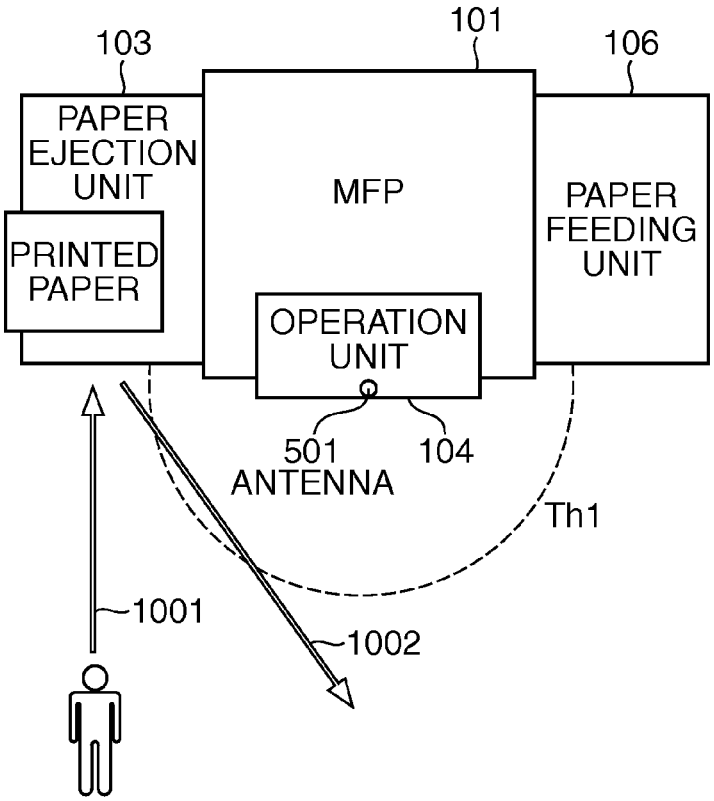
FIG. 10 is a top view showing the MFP having the antenna on the operation unit in which a locus of a user who came to pick up paper to a paper ejection unit of the MFP is entered.

FIG. 10 is a top view showing the MFP 101 having the antenna 501 on the operation unit 104 in which a locus of the user who came to pick up the paper to the paper ejection unit 103 of the MFP 101 is entered.

In FIG. 10, the user approaches the paper ejection unit 103 (arrow 1001) to pick up the ejected paper, and walks across the area in which the intensity detected by the electrostatic capacity detection circuit 701 exceeds the threshold value Th1, after the user picked up the ejected paper (arrow 1002).

Figure 11:
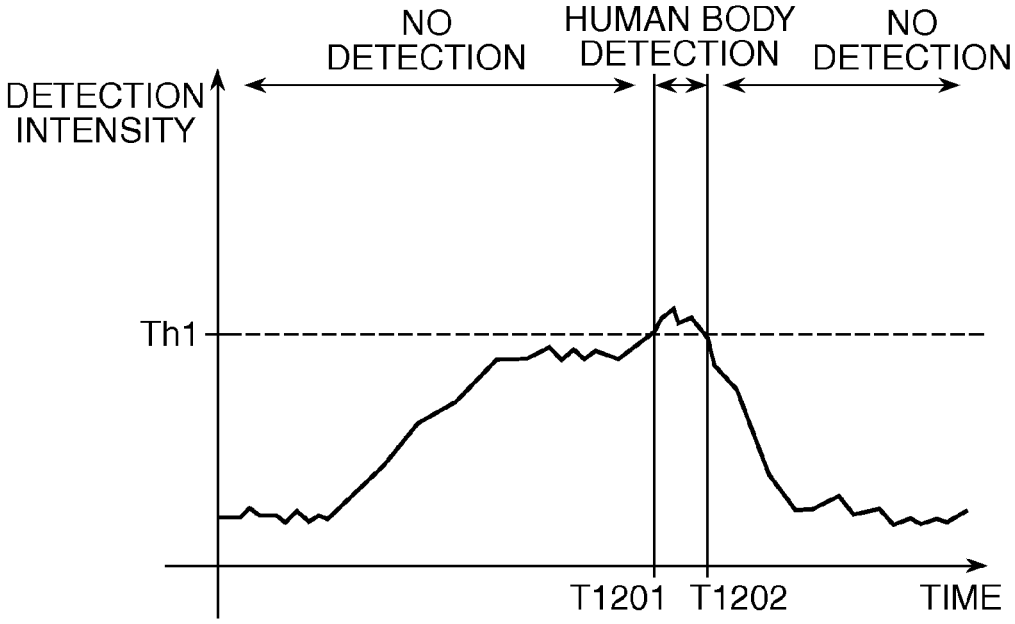
FIG. 11 is a graph showing a relation between detection intensity of the electrostatic capacity detection circuit in FIG. 7 and time with respect to the locus of the user in FIG. 10.

FIG. 11 is a graph showing a relation between detection intensity of the electrostatic capacity detection circuit 701 in FIG. 7 and time with respect to the locus of the user in FIG. 10.

In FIG. 11, since the detection intensity exceeds the threshold value Th1 in a period from T1201 to T1202, if the returning is determined only based on the threshold value, the MFP 101 returns from the power saving mode to the normal mode in spite of the fact that it is unnecessary to return actually. This embodiment proposes a technique of reducing a possibility to return from the power saving mode to the normal mode in such an unnecessary case.

In the first embodiment, an example in which the human body is detected at the operation unit 104 and the paper ejection unit 103 will be described. The reason is to distinguish a user who approaches to operate the operation unit 104 and a user who approaches to pick up the paper ejected to the paper ejection unit 103.

In the first embodiment, the MFP may be the MFP 101 or may be the large-size MFP 201. The device configuration of the MFP is identical to that described with reference to FIG. 1 through FIG. 4.

Figure 12:
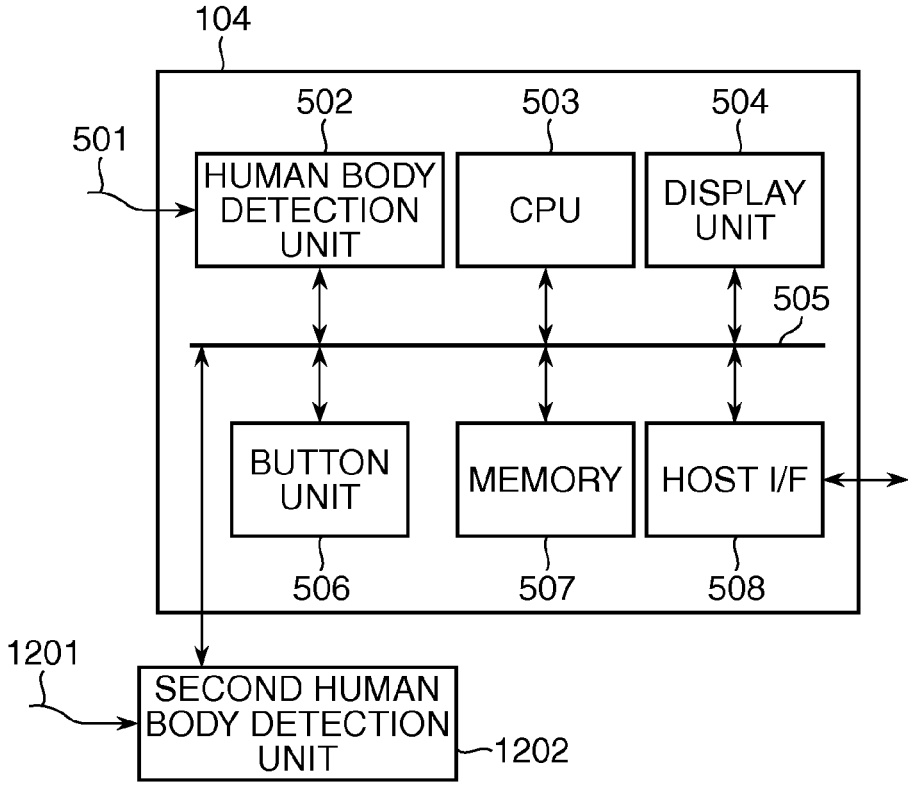
FIG. 12 is a block diagram schematically showing a configuration in which a second human body detection unit is connected to the operation unit in FIG. 3.

FIG. 12 is a block diagram schematically showing a configuration in which a second human body detection unit 1202 (a second living body detection unit) is connected to the operation unit 104 in FIG. 3.

The second human body detection unit 1202 and a second antenna 1201 are added to the configuration of the operation unit 104 shown in FIG. 5. The CPU 503 detects the user who approaches to operate the operation unit 104 according to detection results of the human body detection unit 502 and the second human body detection unit 1202. Since the configuration of the second human body detection unit 1202 is similar to the configuration of the human body detection unit 502 mentioned above, a description for the second human body detection unit 1202 is omitted.

In order to input a trigger from operation unit (operation panel) 104, the human body detection unit 502 (the first living body detection unit) is arranged so that a human body close to an apparatus may be detected. The second human body detection unit 1202 is arranged so as to detect a human body that approaches the device for a purpose other than the input of the trigger.

Figure 13:
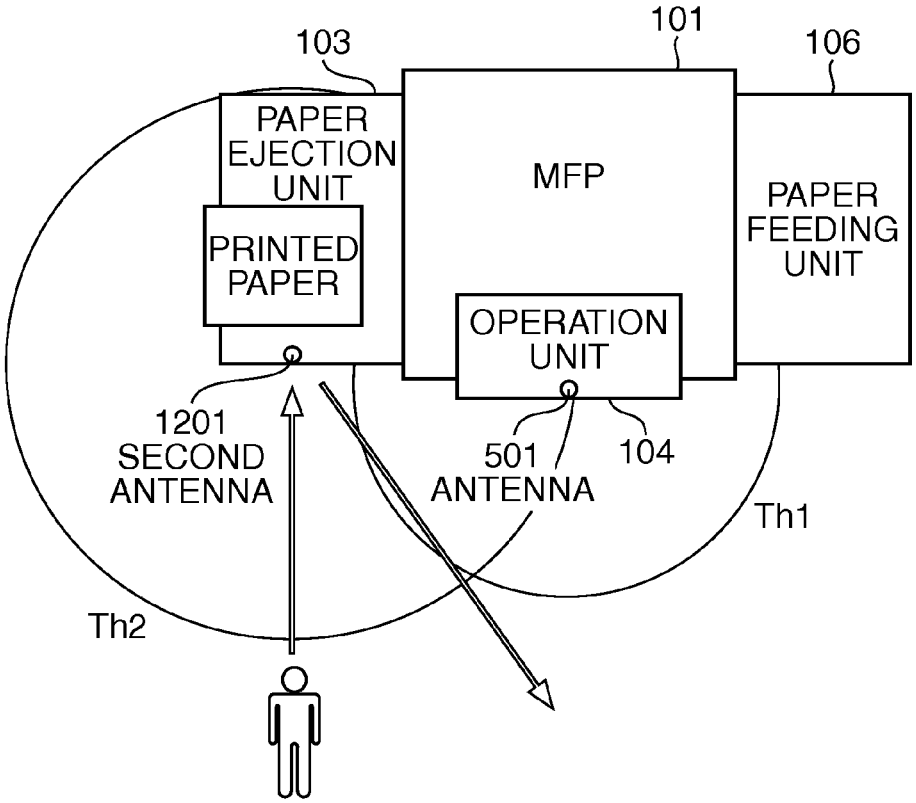
FIG. 13 is a top view showing the MFP having the antenna on the operation unit and a second antenna on the paper ejection unit in which the locus of the user who came to pick up paper to the paper ejection unit is entered.

FIG. 13 is a top view showing the MFP 101 having the antenna 501 on the operation unit 104 and the second antenna 1201 on the paper ejection unit 103 in which the locus of the user who came to pick up the paper to the paper ejection unit 103 is entered.

Figure 14:
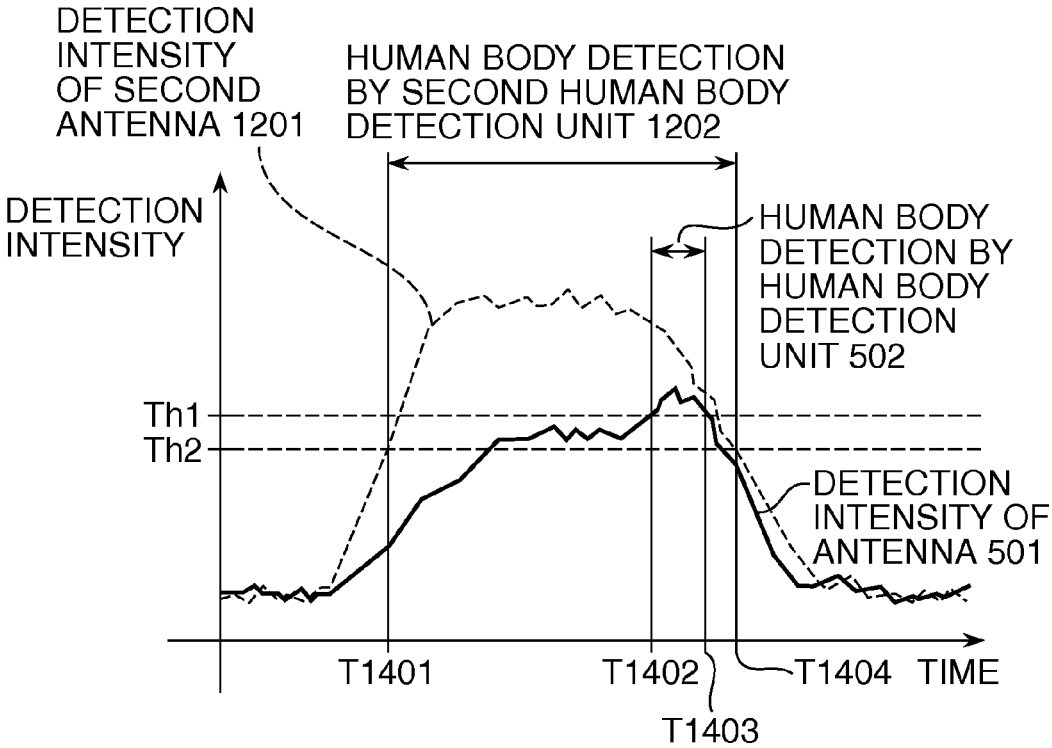
FIG. 14 is a graph showing a relation between detection intensity of the electrostatic capacity detection circuit in FIG. 7 and time with respect to the locus of the user in FIG. 13.

FIG. 14 is a graph showing a relation between detection intensity of the electrostatic capacity detection circuit 701 in FIG. 7 and time with respect to the locus of the user in FIG. 13.

Since the detection intensity of the second human body detection unit 1202 exceeds a threshold value Th2 in a period from T1401 to T1404, it is determined that the human body is detected. Since the detection intensity of the human body detection unit 502 exceeds the threshold value Th1 in a period from T1402 to T1403, the human body is detected.

The CPU 503 of the operation unit 104 determines whether the MFP returns from the power saving mode or not. When the output of the second human body detection unit 1202 is lower than the threshold value Th2 and the output of the human body detection unit 502 is higher than the threshold value Th1, the CPU 503 determines to return from the power saving mode.

That is, when the human body is detected near the paper ejection unit 103, the power saving mode is maintained. On the other hand, when the human body is not detected near the paper ejection unit 103, but is detected near the operation unit 104, the MFP returns from the power saving mode.

This can prevent that the MFP returns from the power saving mode by the approach of the user who comes to pick up the paper from the paper ejection unit 103.

Figure 15:
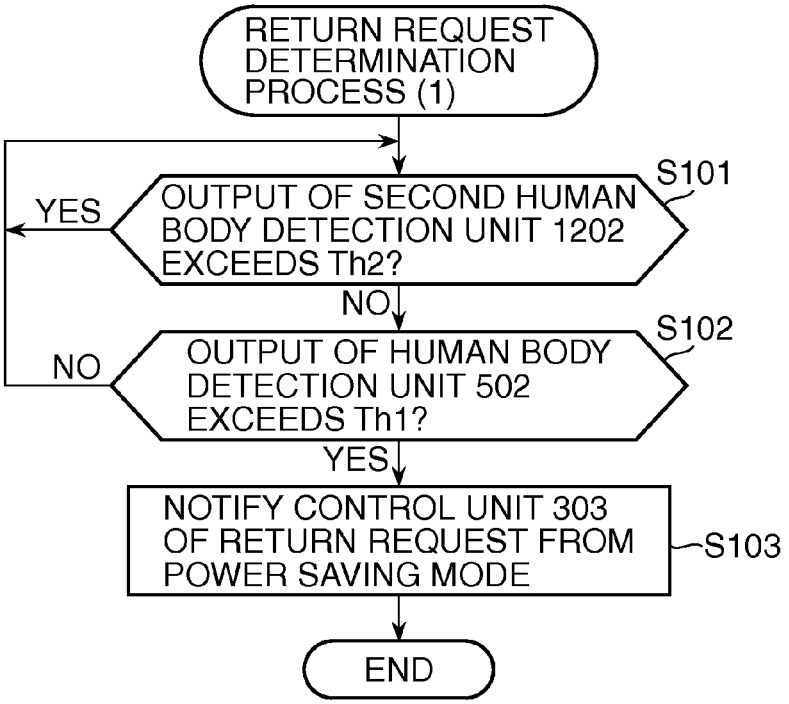
FIG. 15 is a flowchart showing a process to determine whether a return request for returning from a power saving mode executed by a CPU in FIG. 12 is outputted or not (a return request determination process).

FIG. 15 is a flowchart showing a process to determine whether a return request for returning from the power saving mode executed by the CPU 503 in FIG. 12 is outputted or not (a return request determination process). A reference sign S is attached to each process step.

After the MFP 101 shifts to the power saving mode, the CPU 503 of the operation unit 104 starts this flowchart.

After shifting to the power saving mode, in S101, the CPU 503 determines whether the output of the second human body detection unit 1202 exceeds the threshold value Th2 or not. When exceeded, the CPU 503 determines that a return condition from the power saving mode is not satisfied, and performs the process from S101 again. When not exceeded, in S102, the CPU 503 determines whether the output of the human body detection unit 502 exceeds the threshold value Th1 or not.

When not exceeded, the CPU 503 determines that the return condition from the power saving mode is not satisfied, and performs the process from the S101. When exceeded, in S103, the CPU 503 notifies the control unit 303 of the return request for returning from the power saving mode. The control unit 303 shifts the mode of the MFP to the normal mode from the power saving mode by changing the electric power source control signal 304.

As mentioned above, since the second antenna 1201 is added to the paper ejection unit 103 to combine with the antenna 501 equipped on the operation unit 104, it can reduce the possibility of returning from the power saving mode due to detection of the user who comes to pick up paper that is outputted to the paper ejection unit 103.

Although the second antenna 1201 is arranged on the paper ejection unit 103 in this embodiment, it may be arranged on the paper feeding unit 106 or other positions. For example, when the second antenna 1201 is arranged on the paper feeding unit 106, the user who approaches the MFP 101 for the purpose of supplementing paper to the paper feeding unit 106 can be detected. In this case, the similar control as mentioned above can reduce the possibility of returning from the power saving mode due to detection of the user who comes to supplements paper.

In a second embodiment, an example in which the threshold value Th1 for detecting the human body in the human body detection unit 502 varies in two steps is described.

In the configuration described in the first embodiment, when a user forms a locus to approach the operation unit 104 after the user goes to the paper ejection unit 103 to pick up paper, the CPU 503 cannot output the return request for returning from the power saving mode quickly to the control unit 303. The second embodiment solves the above-mentioned disadvantage of the first embodiment.

For example, when a user checks the paper ejection unit 103 and does not find desired output paper, the user approaches the operation unit 104 to check the condition after approaching the paper ejection unit 103. Since the configuration of the device is similar to that of the first embodiment, the description of the configuration of the second embodiment is omitted.

Figure 16:
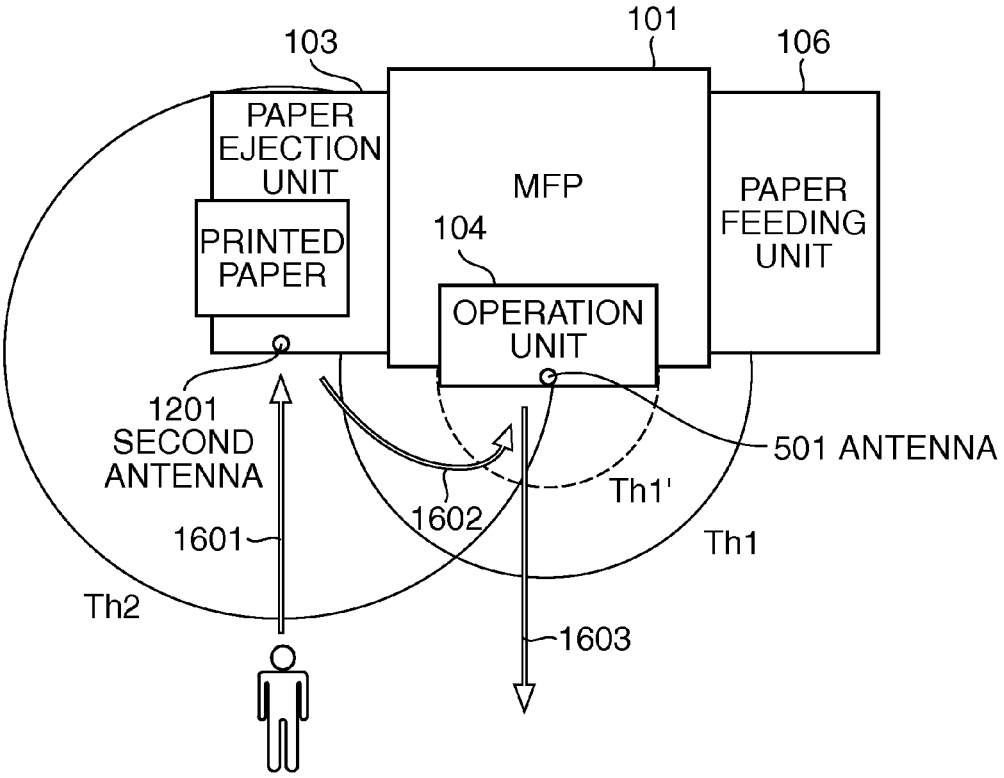
FIG. 16 is a top view showing the MFP having the antenna on the operation unit and the second antenna on the paper ejection unit in which the locus of the user who used the operation unit after coming to pick up paper to the paper ejection unit, and then left the MFP is entered.

FIG. 16 is a top view showing the MFP 101 having the antenna 501 on the operation unit 104 and the second antenna 1201 on the paper ejection unit 103 in which a locus of a user who used the operation unit 104 after coming to pick up paper to the paper ejection unit 103, and then left the MFP 101 is entered.

Arrows 1601, 1602, and 1603 show user's moving loci. If an area in which the human body detection intensity of the second human body detection unit 1202 exceeds the threshold value Th2 includes the operation unit 104, the configuration of the first embodiment does not output a return request for returning from the power saving mode even if the user approaches the operation unit 104. According to the second embodiment, the human body detection intensity in the human body detection unit 502 is determined based on two steps of the threshold values Th1 (a first detection intensity) and Th1' (a second detection intensity).

Figure 17:
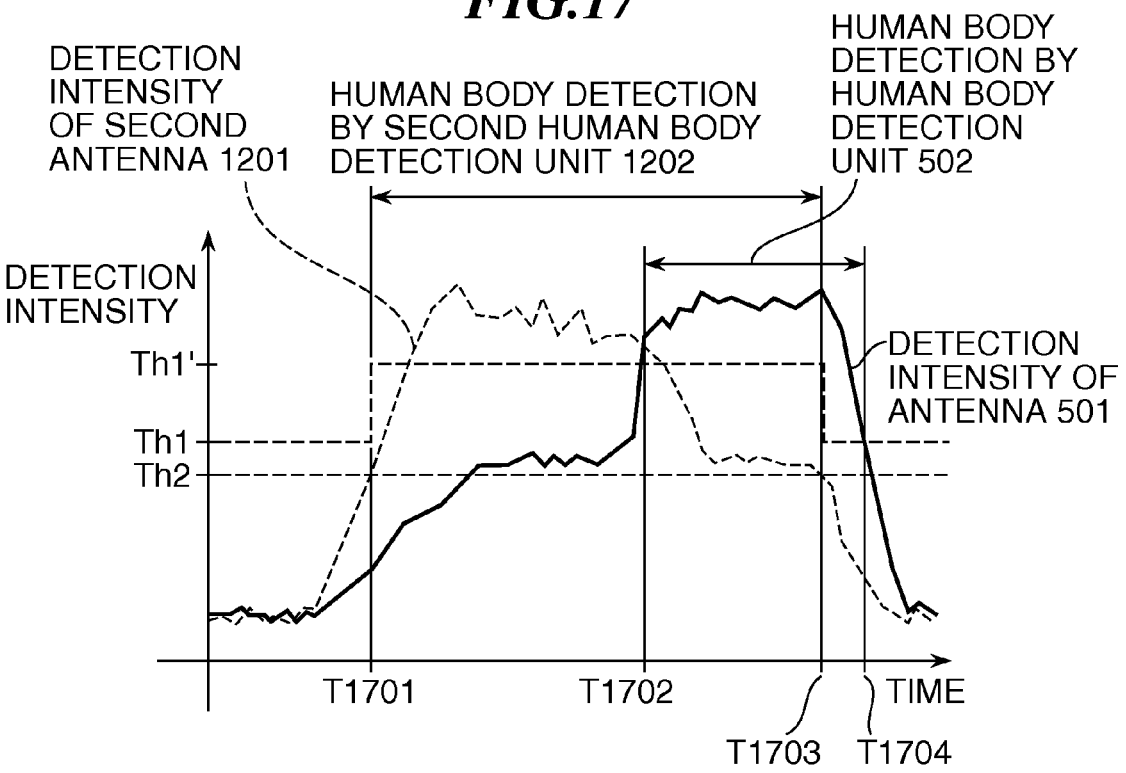
FIG. 17 is a graph showing a relation between detection intensity of the electrostatic capacity detection circuit in FIG. 7 and time with respect to the locus of the user in FIG. 16.

FIG. 17 is a graph showing a relation between detection intensity of the electrostatic capacity detection circuit 701 in FIG. 7 and time with respect to the locus of the user in FIG. 16.

In FIG. 17, a period from T1701 to T1703 is a period during which the second human body detection unit 1202 detects a human body. In this period, the human body detection intensity of the human body detection unit 502 equipped on the operation unit 104 is changed to the threshold value Th1'.

A period from T1702 to T1704 is a period during which the human body detection intensity of the human body detection unit 502 exceeds the threshold value. The CPU 503 of the operation unit 104 outputs a return request for returning from the power saving mode to the control unit 303 at the time of T1702.

Figure 18:
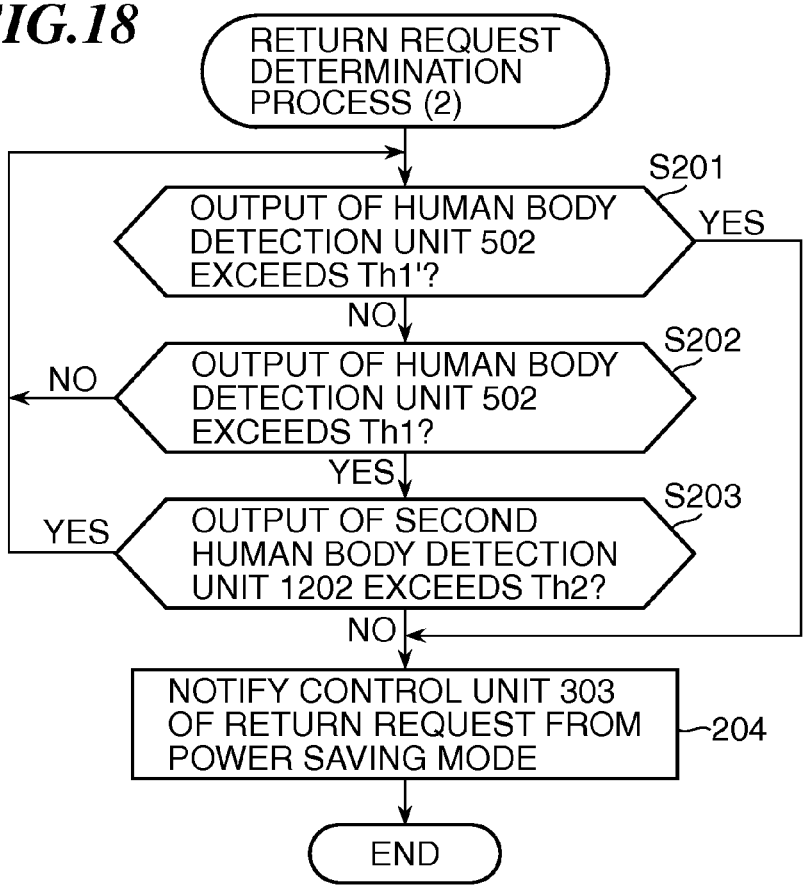
FIG. 18 is a flowchart showing a process to determine whether the return request for returning from the power saving mode executed by the CPU in FIG. 12 is outputted or not (the return request determination process).

FIG. 18 is a flowchart showing a process to determine whether a return request for returning from the power saving mode executed by the CPU 503 in FIG. 12 is outputted or not (a return request determination process). A reference sign S is attached to each process step.

After the MFP 101 shifts to the power saving mode, the CPU 503 of the operation unit 104 starts this flowchart.

After shifting to the power saving mode from the normal mode, in S201, the CPU 503 determines whether an output of the human body detection unit 502 exceeds the threshold value Th1' or not. When exceeded, the CPU 503 determines that a return condition from the power saving mode is satisfied, and notifies the control unit 303 of a return request for returning from the power saving mode in S204. When not exceeded, in S202, the CPU 503 determines whether the output of the human body detection unit 502 exceeds the threshold value Th1.

When not exceeded, the CPU 503 determines that the return condition from the power saving mode is not satisfied, and performs the process from the S201 again. When exceeded, in S203, the CPU 503 determines whether an output of the second human body detection unit 1202 exceeds the threshold value Th2 or not.

When exceeded, the CPU 503 determines that the return condition from the power saving mode is not satisfied, and performs the process from the S201 again. When not exceeded, in S204, the CPU 503 notifies the control unit 303 of the return request from the power saving mode to the normal mode.

As described above, Th1' that is higher than Th1 is set as the threshold value for the detection intensity, and when the output of the human body detection unit 502 exceeds Th1' (i.e., when the user approaches the operation unit 104 sufficiently), the return request for returning from the power saving mode to the normal mode can be outputted. When the output of the human body detection unit 502 exceeds Th1, and when the output of the second human body detection unit 1202 is lower than Th2 (i.e., even when the user moves to the operation unit 104 from the paper ejection unit 103), the return request for returning from the power saving mode to the normal mode can be outputted.

In a third embodiment, an example in which a sensor to detect ejected paper to the paper ejection unit 103 is used instead of the second human body detection unit 1202 described in the first embodiment is described. This embodiment uses a fact that a possibility that the user comes to the paper ejection unit 103 becomes low when the paper is not ejected. Since a cost of the paper sensor is cheaper than that of the human body detection unit, the third embodiment has an advantage that achieves lower cost as compared with the second embodiment.

Figure 19:
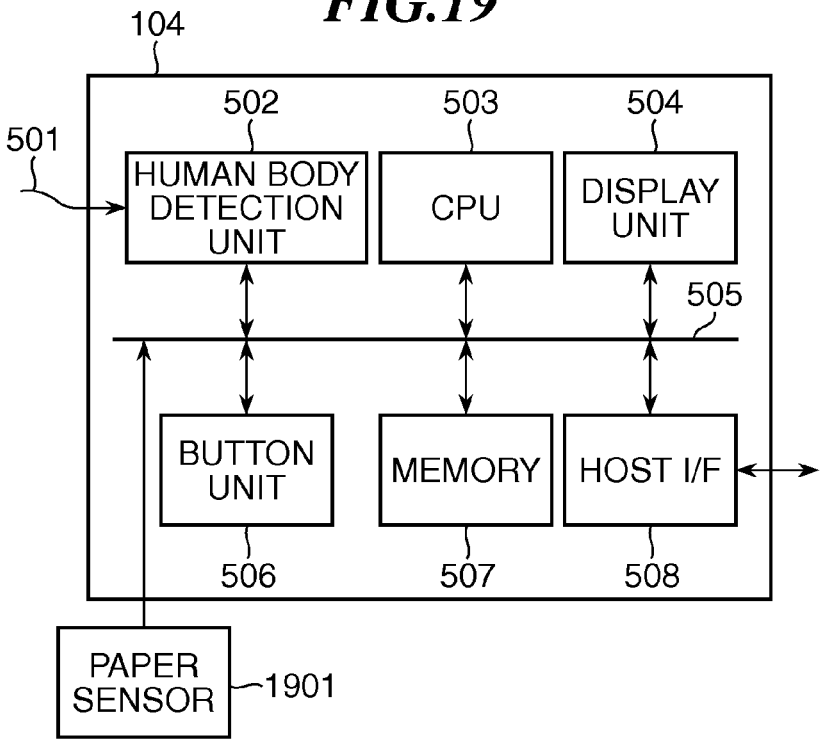
FIG. 19 is a block diagram showing the configuration in which a paper sensor is connected to the operation unit in FIG. 3.

FIG. 19 is a block diagram showing the configuration in which the paper sensor 1901 is connected to the operation unit 104 in FIG. 3.

The paper sensor 1901 is used instead of the second human body detection unit 1202 in FIG. 12. The CPU 503 reads a value that the paper sensor 1901 outputs, and determines whether there is paper ejected to the paper ejection unit 103 or not.

Here, the paper sensor 1901 functions as a condition detection unit that detects a specific condition of the device.

Figure 20:
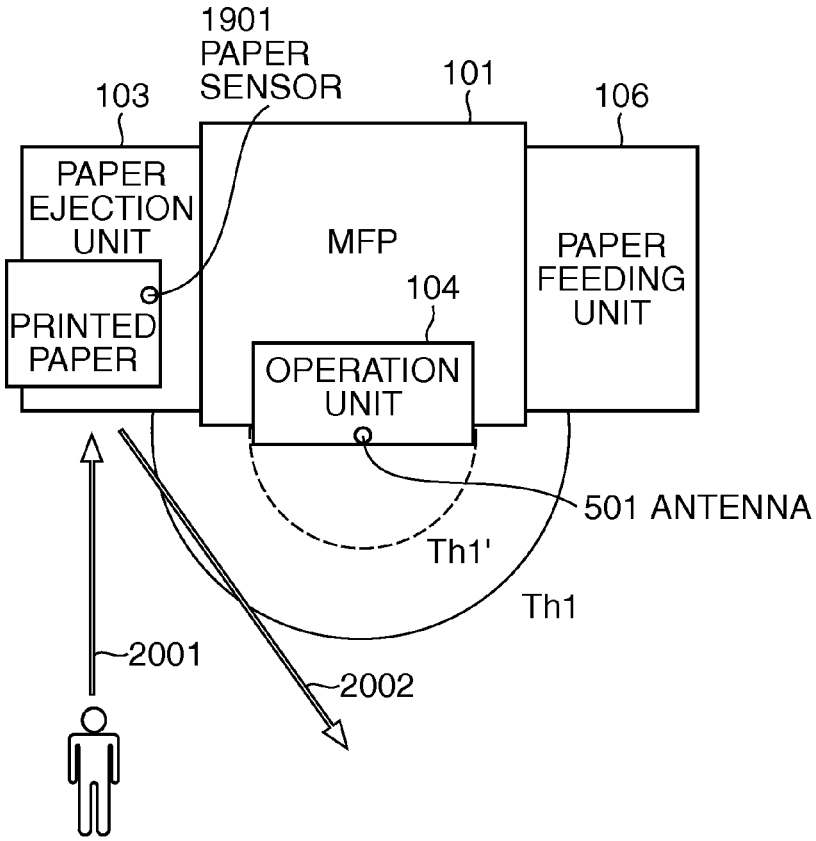
FIG. 20 is a top view showing the MFP having the antenna on the operation unit and the paper sensor on the paper ejection unit in which the locus of the user who came to pick up paper to the paper ejection unit is entered.

FIG. 20 is a top view of the MFP 101 having the antenna 501 on the operation unit 104 and the paper sensor 1901 on the paper ejection unit 103 in which a locus of a user who came to pick up the paper to the paper ejection unit 103 is entered.

When the paper sensor 1901 is detecting paper, there is a possibility that a user comes to the paper ejection unit 103 to pick up the paper. Therefore, the human body detection unit 502 narrows the detection area by raising the threshold value for the detection intensity as shown in a circle of the threshold value Th1' in FIG. 20. When the paper sensor 1901 is not detecting paper, the possibility that a user comes to the paper ejection unit 103 to pick up paper is low. Therefore, the human body detection unit 502 lowers the threshold value for the detection intensity, as shown in the circle of threshold Th1 of FIG. 20.

Figure 21:
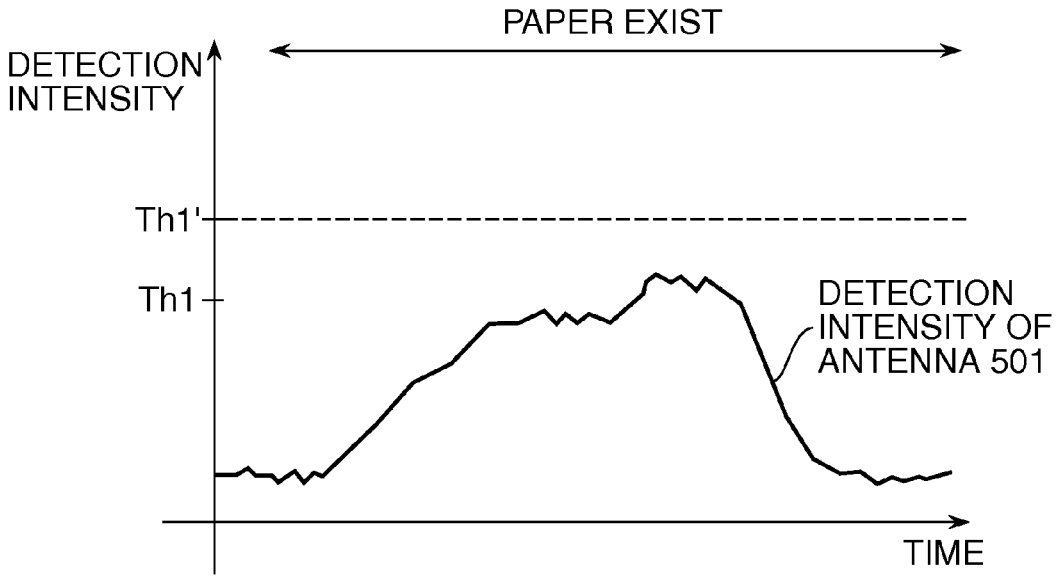
FIG. 21 is a graph showing a relation between detection intensity of the electrostatic capacity detection circuit in FIG. 7 and time with respect to the locus of the user in FIG. 20.

FIG. 21 is a graph showing a relation between detection intensity of the electrostatic capacity detection circuit 701 in FIG. 7 and time with respect to the locus of the user in FIG. 20.

As an example, a condition where the paper sensor 1901 is detecting paper is shown. The threshold value for detection intensity of the human body detection unit 502 is Th1'. Therefore, when the user approaches the paper ejection unit 103 (an arrow 2001 in FIG. 20) to pick up the paper and then leaves from the paper ejection unit 103 (an arrow 2002 in FIG. 20), the detection intensity does not exceed the threshold value Th1', which does not generate a return request for returning from the power saving mode to the normal mode.

Figure 22:
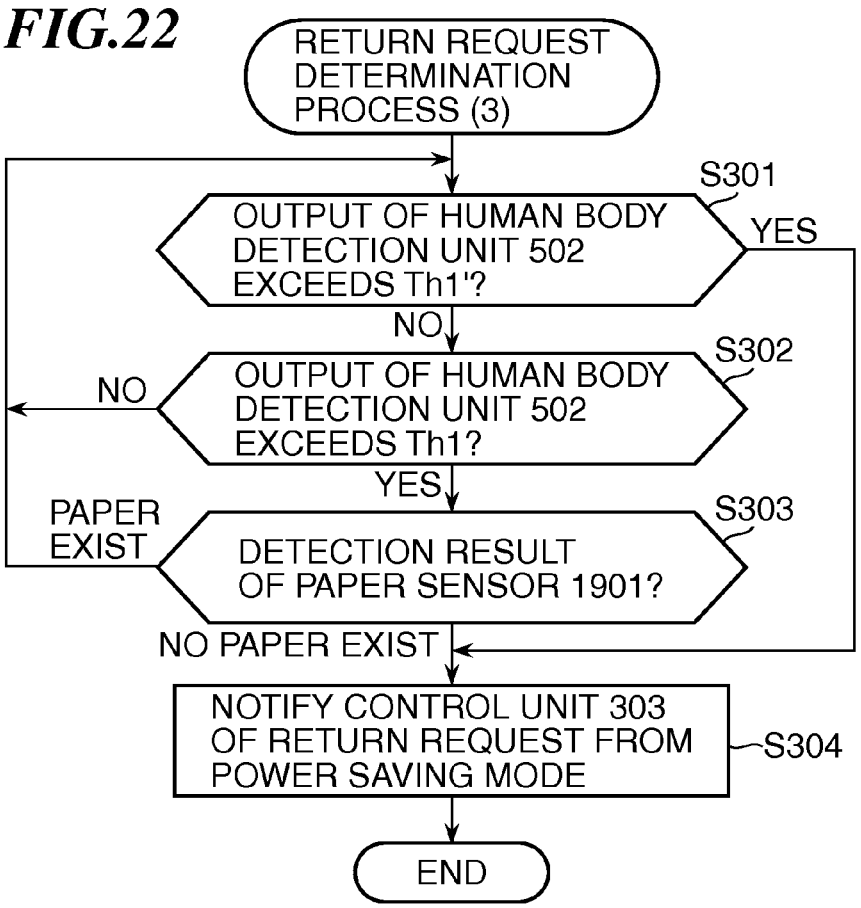
FIG. 22 is a flowchart showing a process to determine whether the return request for returning from the power saving mode executed by the CPU in FIG. 19 is outputted or not (the return request determination process).

FIG. 22 is a flowchart showing a process to determine whether a return request for returning from a power saving mode executed by the CPU 503 in FIG. 19 is outputted or not (a return request determination process). A reference sign S is attached to each process step.

After the MFP 101 shifts to the power saving mode, the CPU 503 of the operation unit 104 starts this flowchart.

After shifting to the power saving mode, in S301, the CPU 503 determines whether the output of the human body detection unit 502 exceeds the threshold value Th1' or not. When exceeded, the CPU 503 determines that a return condition from the power saving mode is satisfied, and notifies the control unit 303 of the return request for returning from the power saving mode in S304.

When not exceeded, in S302, the CPU 503 determines whether the output of the human body detection unit 502 exceeds the threshold value Th1 or not. When not exceeded, the CPU 503 determines that the return condition from the power saving mode is not satisfied, and performs the process from S301.

When exceeded, in S303, the CPU 503 determines the output of the paper sensor 1901. When there is the paper, since there is a high possibility that the user comes to the paper ejection unit 103 to pick up paper, the CPU 503 determines that the return condition from the power saving mode is not satisfied, and performs the process from S301 again.

When there is no paper, since there is a low possibility that the user comes to pick up the paper, the CPU 503 determines that the user comes to operate the MFP 101, and notifies the control unit 303 of the return request for returning from the power saving mode to the normal mode in S304.

Although in this embodiment, it is described that the example in which the paper sensor 1901 is arranged on the paper ejection unit 103, the paper sensor may be arranged on the paper feeding unit 106 in order to distinguish a user who operates the MFP and a user who supplements paper to the paper feeding unit 106. Furthermore, a toner sensor may be arranged in the toner supplying unit 207 in order to distinguish a user who operates the MFP and a user who supplements the toner.

In a fourth embodiment, it is described that an example that takes measures against a situation in the configuration described in the third embodiment where the threshold value for a human body detection intensity of the human body detection unit 502 varies from Th1 to Th1 when a user picks up all the ejected paper and the paper sensor 1901 detects no paper.

In the third embodiment, since the CPU 503 determines that there is no paper at a time when the user picks up all the paper from the paper ejection unit 103, the threshold value for the human body detection intensity of the human body detection unit 502 varies from Th1' to Th1. When the user enters an area defined by a circle of the threshold value Th1 but does not enters the area defined by the circle of the threshold value Th1', the configuration of the third embodiment issues a return request for returning from the power saving mode at the time. This is an incorrect determination.

Dealing with the situation, in the fourth embodiment, a timer is added to the configuration of the third embodiment to reduce the possibility of the incorrect determination. The timer starts measurement when an output of the paper sensor 1901 changes from "paper exists" to "paper does not exist", and measures until a fixed time Td elapses.

When the fixed time Td elapses, the threshold value for a detection intensity of the human body detection unit 502 is changed from Th1' to Th1. The fixed time Td is set beforehand on an assumption of a period needed for a user who comes to pick up paper to the paper ejection unit 103 and leaves from the MFP 101. For example, if the period needed for the user to leave from the MFP 101 is assumed as about 3 seconds on average, the fixed time Td is set as 5 seconds by adding a little margin.

Figure 23:
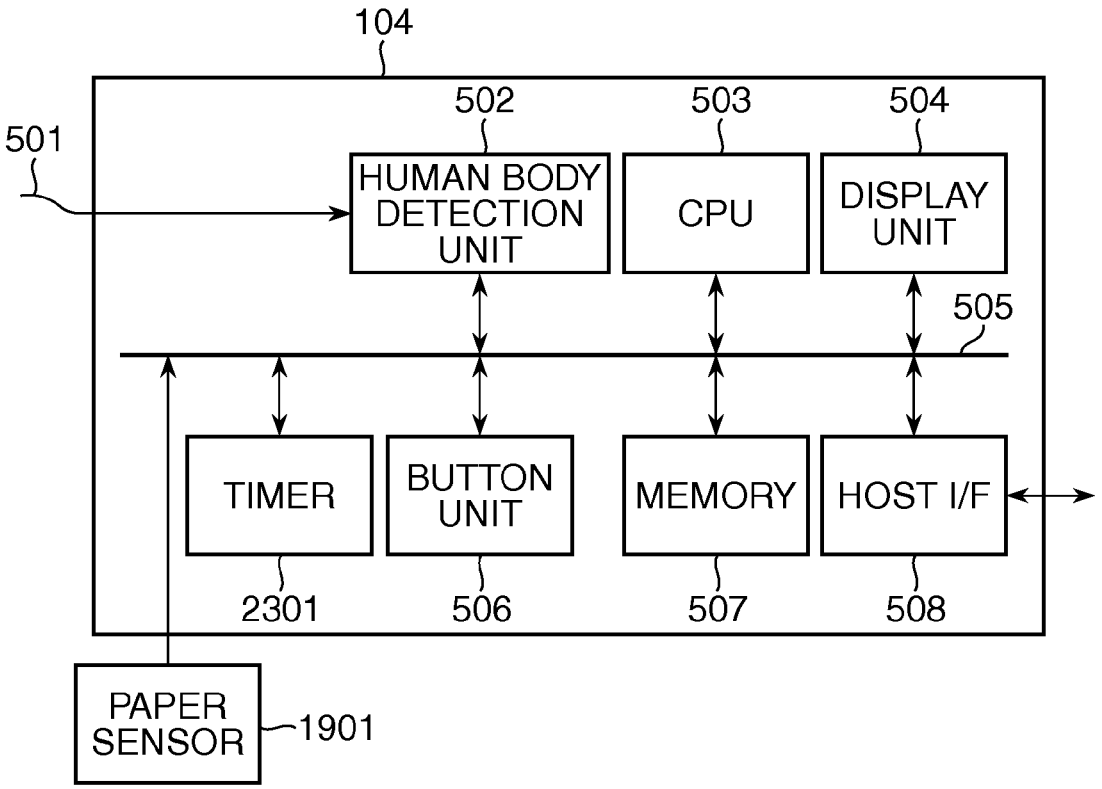
FIG. 23 is a block diagram schematically showing a configuration in which a timer is added to the operation unit in FIG. 3.

FIG. 23 is a block diagram schematically showing a configuration in which the timer 2301 is added to the operation unit 104 in FIG. 3.

The CPU 503 initializes a timer value of the timer 2301. The timer 2301 increments the timer value as time elapses. The CPU 503 determines whether the timer value exceeds the fixed time Td or not.

Figure 24:
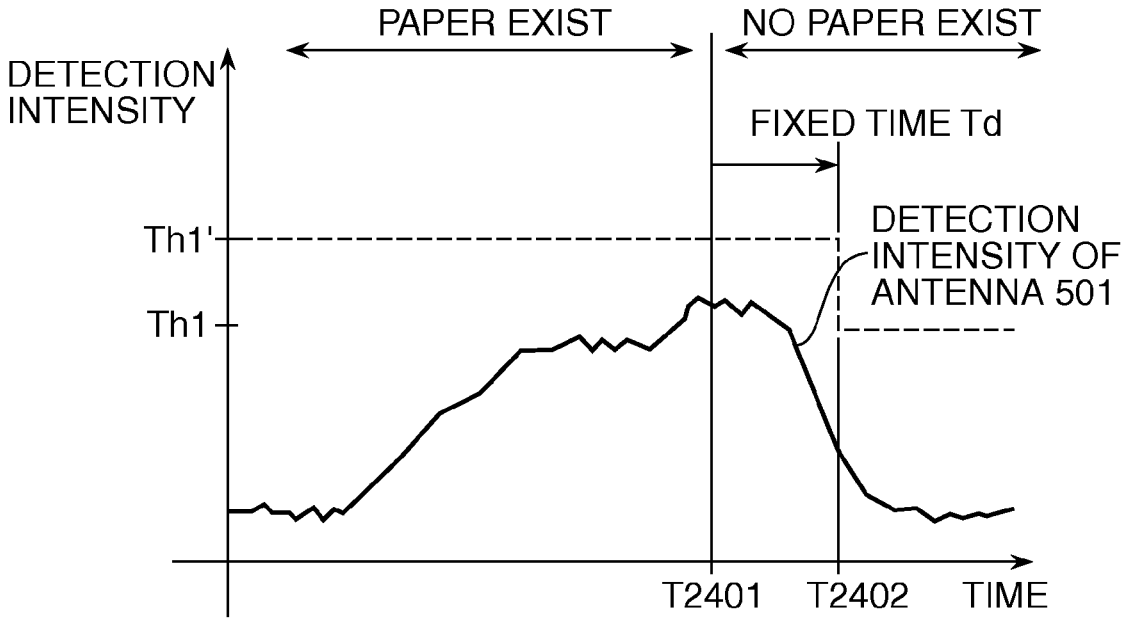
FIG. 24 is a graph showing a relation between detection intensity of an electrostatic capacity detection circuit in FIG. 7 and time with respect to the locus of the user in FIG. 20.

FIG. 24 is a graph showing a relation between detection intensity of the electrostatic capacity detection circuit 701 in FIG. 7 and time with respect to the locus of the user in FIG. 20.

The user picks up all the paper ejected to the paper ejection unit 103 at T2401. At this time, the output of the human body detection unit 502 to which the antenna 501 arranged on the operation unit 104 is connected exceeds the threshold value Th1. However, in this embodiment, since a standard value for the human body detection maintains the threshold value Th1' in the fixed time Td after the output of the paper sensor 1901 changes from "paper exists" to "paper does not exist", the CPU 503 of the operation unit 104 does not output a return request for returning from the power saving mode.

Although the standard value of the human body detection is changed to the threshold value Th1 at the time of T2402 after the fixed time Td elapses, the user leaves from the MFP 101 at this time and the detection intensity is low. Therefore, the return request for returning from the power saving mode is not outputted.

Figure 25:
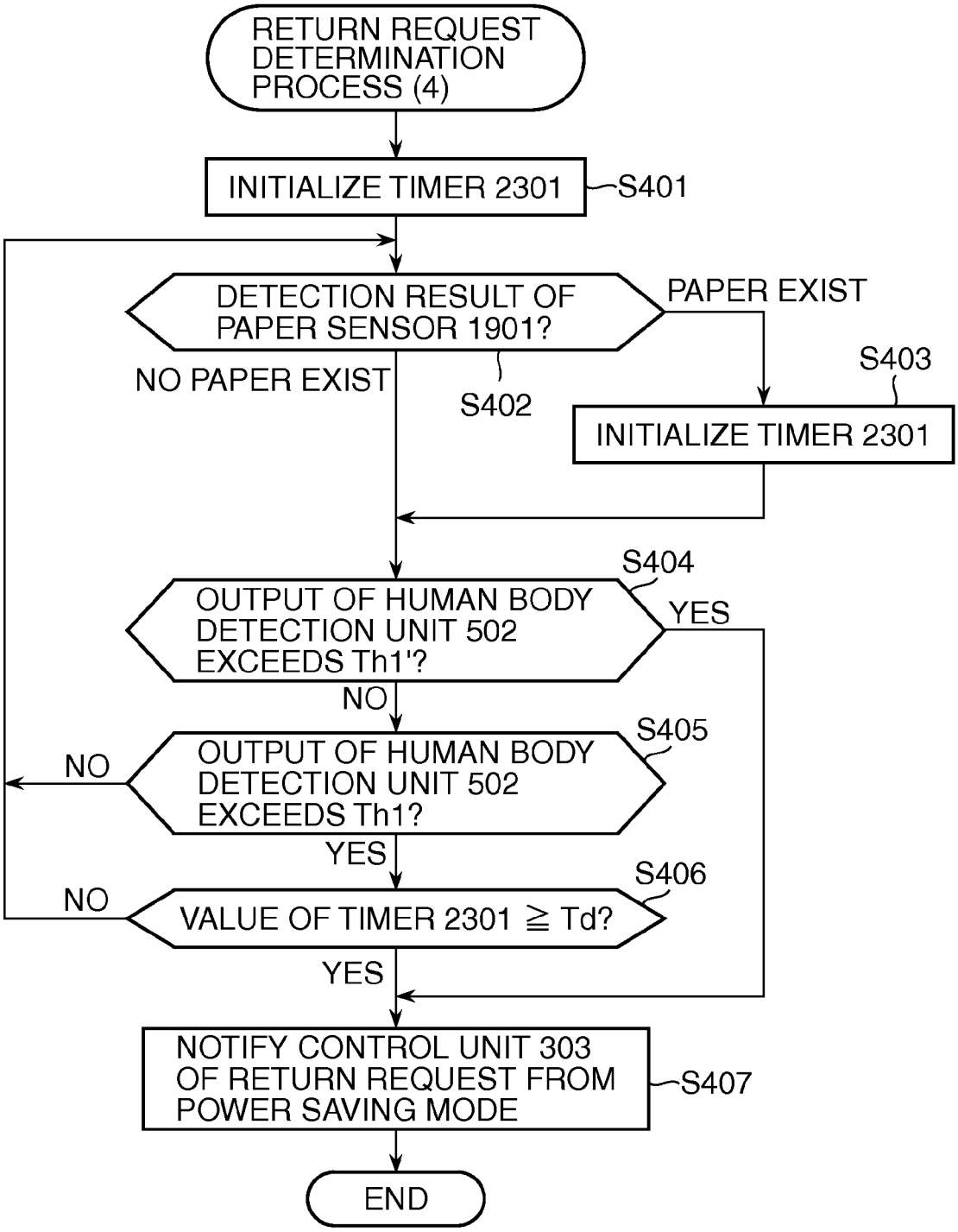
FIG. 25 is a flowchart showing a process to determine whether the return request for returning from the power saving mode executed by the CPU in FIG. 23 is outputted or not (the return request determination process).

FIG. 25 is a flowchart showing a process to determine whether a return request for returning from the power saving mode executed by the CPU 503 in FIG. 23 is outputted or not (a return request determination process). A reference sign S is attached to each process step.

After the MFP 101 shifts to the power saving mode, the CPU 503 of the operation unit 104 starts this flowchart.

After shifting to the power saving mode, in S401, the CPU 503 initializes the timer 2301. In S402, the CPU 503 determines a detection result of the paper sensor 1901. When paper exists, the CPU 503 initializes the timer 2301 in S403. The timer 2301 always counts up. However, since the count-up is unnecessary when the paper exists, the timer is initialized.

When the paper does not exist, the timer 2301 counts up. That is, the timer 2301 counts up from a time when a condition is changed from "paper exists" to "paper does not exist".

In S404, the CPU 503 determines whether an output of the human body detection unit 502 exceeds the threshold value Th1' or not. When exceeded, the CPU 503 determines that a return condition from the power saving mode is satisfied, and notifies the control unit 303 of a return request for returning from the power saving mode in S407.

When not exceeded, in S405, the CPU 503 determines whether the output of the human body detection unit 502 exceeds the threshold value Th1 or not. When not exceeded, the CPU 503 determines that the return condition from the power saving mode is not satisfied, and performs the process from the S402. When exceeded, in S406, the CPU 503 determines whether the value of the timer 2301 is equal to or larger than the fixed time Td.

When the timer value is smaller than the fixed time Td, there is a high possibility that the paper does not exist or the user does not leave after picking up the paper. Therefore, the CPU 503 determines that the return condition from the power saving mode is not satisfied, and performs the process from the S402 again.

When the timer value is equal to or larger than the fixed time Td, there is a high possibility that the user leaves from the MFP 101 even if the user came to pick up the paper. Therefore, the CPU 503 notifies the control unit 303 of the returning request for returning from the power saving mode in the S407.

As described above, the use of the timer 2301 can reduce a possibility of retuning from the power saving mode when the user picked up all the paper.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-061435, filed on Mar. 13, 2009, which is hereby incorporated by reference herein in its entirety.

What is claimed is:

1. An image processing apparatus that has a first mode in which electric power is supplied to a part of the image processing apparatus and a second mode in which electric power is not supplied to the part of the image processing apparatus, the image processing apparatus comprising:

a first detection unit adapted to detect a change of state;

a second detection unit adapted to, in response to, and after, a detected change of state by the first detection unit, start a detecting operation, and detect an object; and a control unit adapted to switch the electric power mode of the image processing apparatus from the second mode to the first mode in a case where said second detection unit detects the object.

2. The image processing apparatus according to claim 1, wherein said second detection unit detects the object that approaches to the image processing apparatus.

3. The image processing apparatus according to claim 1, wherein said control unit switches the electric power mode of the image processing apparatus from the second mode to the first mode when said second detection unit detects the object after a predetermined time period has elapsed.

4. The image processing apparatus according to claim 3, further comprising a timer adapted to store information indicative of the predetermined time period.

5. The image processing apparatus according to claim 1, wherein electric power consumption in the second mode is lower than that in the first mode.

6. The image processing apparatus according to claim 1, further comprising:

a printer unit adapted to print image on paper.

7. The image processing apparatus according to claim 6, wherein the electric power is not supplied to the printer unit in the second mode, and the electric power is supplied to the printer unit in the first mode.

8. The image processing apparatus according to claim 1, wherein each of the first detection unit and the second detection unit is a sensor.

9. A control method for an image processing apparatus that has a first mode in which electric power is supply to a part of the image processing apparatus and a second mode in which electric power is not supply to the part of the image processing apparatus, the control method comprising:

detecting, by a first detecting unit, change of state;

in response to, and after, a detected change of state by the first detection unit, starting a detecting operation, and detecting an object, by a second detecting unit;

switching, by a control unit, the electric power mode of the image processing apparatus from the second mode to the first mode in a case where the object is detected by the second detecting unit.

10. The control method according to claim 9, wherein said control unit switches the electric power mode of the image processing apparatus from the second mode to the first mode when said second detection unit detects the object after a predetermined time period has elapsed.

11. The control method according to claim 9, further comprising:

printing an image on paper in the first mode.

12. The image processing apparatus according to claim 1, wherein the operation of the second detection unit is linked to the operation of the first detection unit.

* * * * *